United States Patent [19]

Kerfoot, Jr.

[11] Patent Number: 5,064,071

[45] Date of Patent: Nov. 12, 1991

[54] CONTAINER APPARATUS

[75] Inventor: Franklin W. Kerfoot, Jr., Newtown Square, Pa.

[73] Assignee: Kerfoot Corporation, Newtown Square, Pa.

[21] Appl. No.: 504,888

[22] Filed: Apr. 5, 1990

[51] Int. Cl.[5] ..... B65D 85/56

[52] U.S. Cl. ..... 206/534; 383/39; 383/106

[58] Field of Search ..... 383/106, 39; 206/534

[56] References Cited

U.S. PATENT DOCUMENTS

| | | | |
|---|---|---|---|
| 2,679,877 | 6/1954 | Leggett | 383/39 X |
| 2,754,867 | 7/1956 | Langer | 383/106 X |
| 3,530,961 | 9/1970 | Weissenbach | 383/106 X |
| 4,234,086 | 11/1980 | Dorton | 383/106 X |
| 4,401,213 | 8/1983 | Lerner | 383/106 X |
| 4,744,673 | 5/1988 | Nakamura | 383/39 X |
| 4,811,845 | 3/1989 | Baggett | 383/106 X |
| 4,890,741 | 1/1990 | Edelstein | 206/534 |

FOREIGN PATENT DOCUMENTS

| | | | |
|---|---|---|---|
| 2066209 | 7/1981 | United Kingdom | 206/459 |
| 2143504 | 2/1985 | United Kingdom | 383/106 |

*Primary Examiner*—William I. Price

*Attorney, Agent, or Firm*—Rene A. Kuypers

[57] ABSTRACT

A container apparatus for small items such as drug medication. The container is designed for drugs or similar small articles which allows an attendant to dispense the items in accordance with printed or pictorial information provided upon the container or a separate sheet maintained within a pocket of the container.

15 Claims, 4 Drawing Sheets

FIG. 1
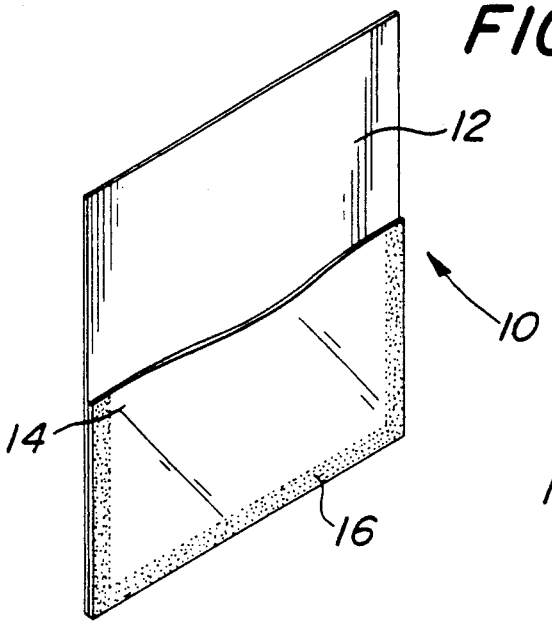
FIG. 2
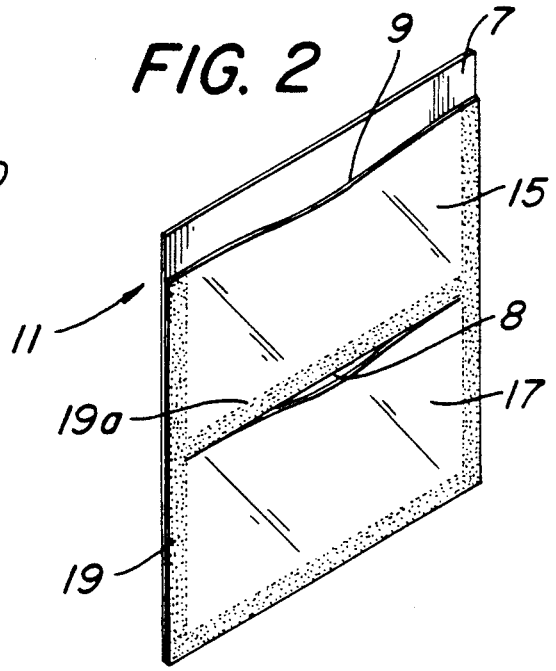
FIG. 3
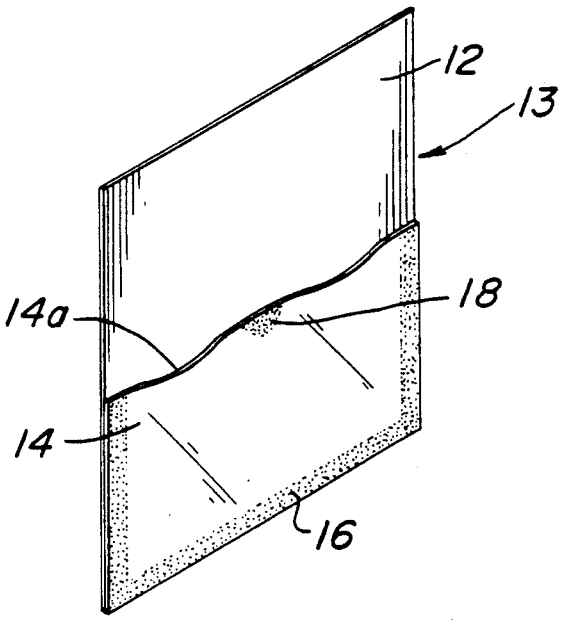
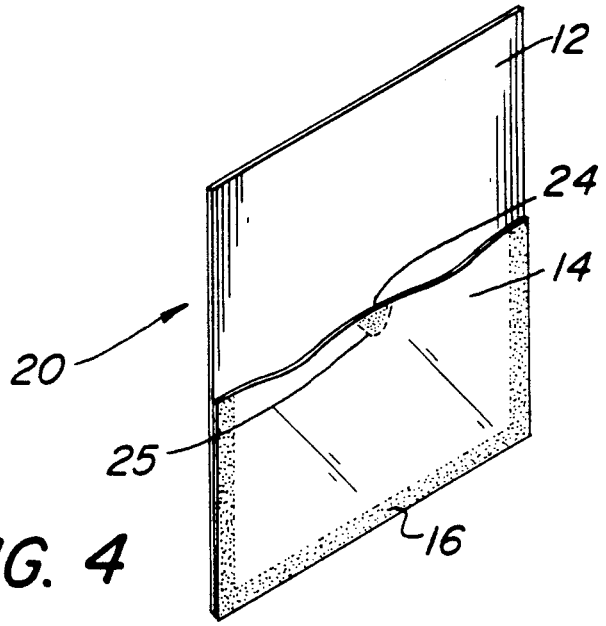
FIG. 4

FIG. 5
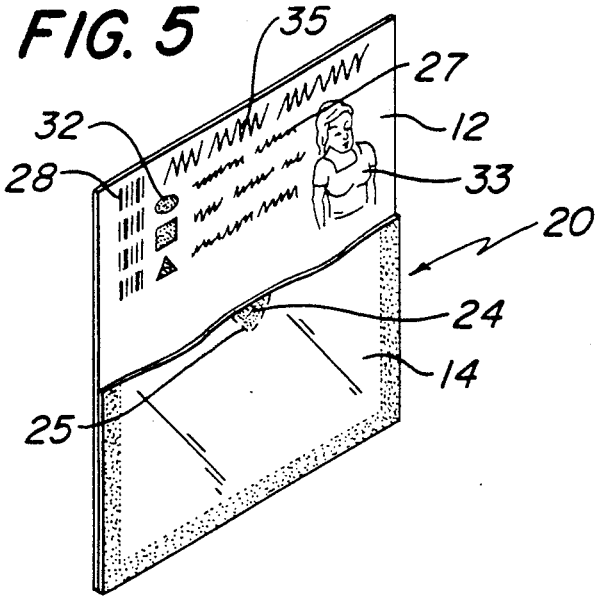
FIG. 6
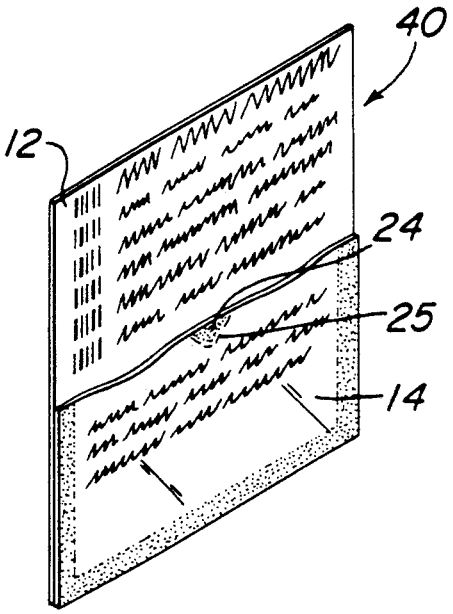
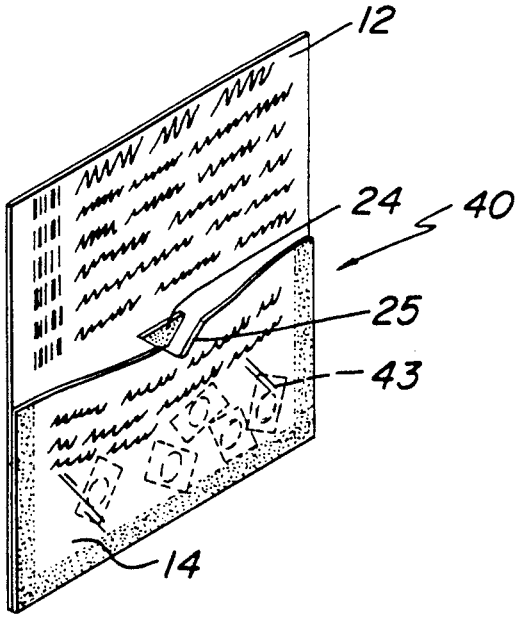
FIG. 7
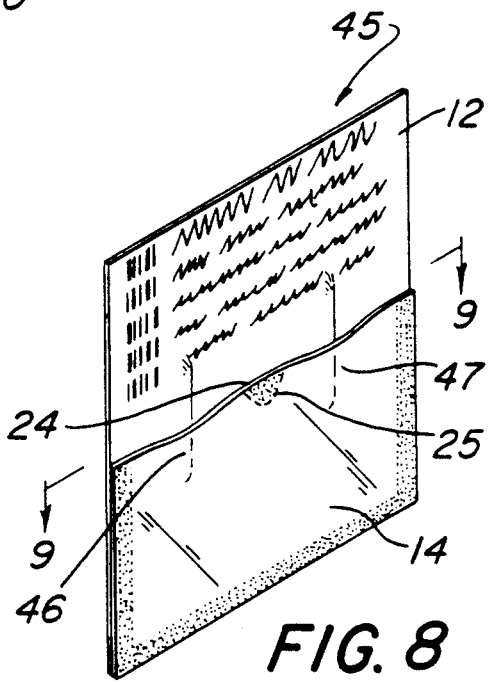
FIG. 8

FIG. 9
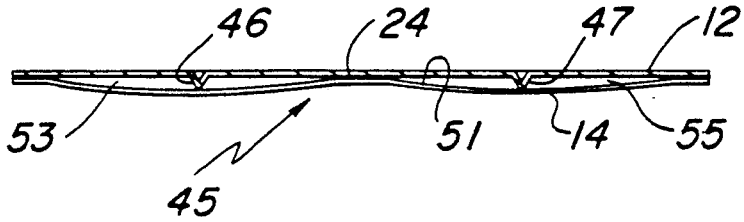
FIG. 10
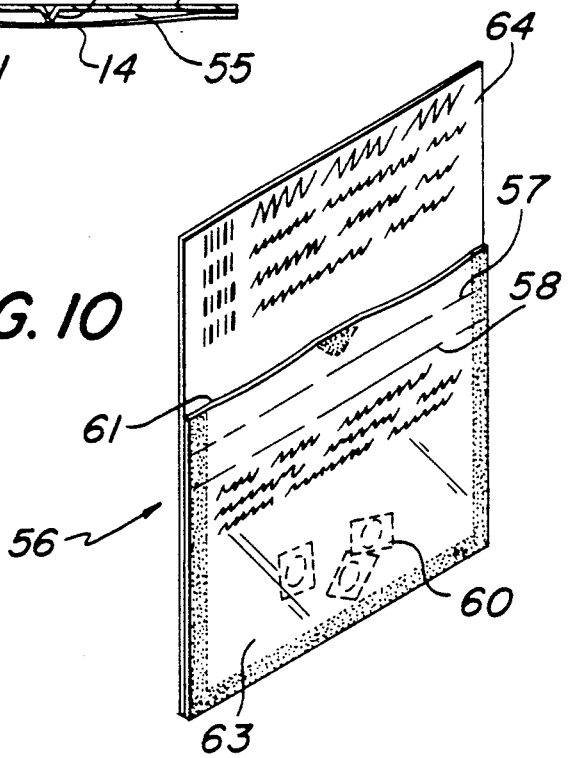
FIG. 11
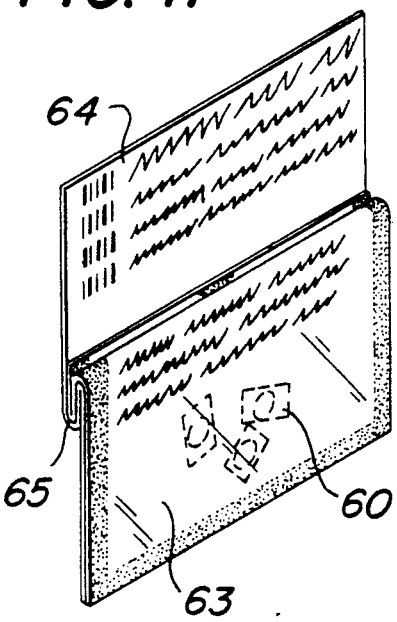
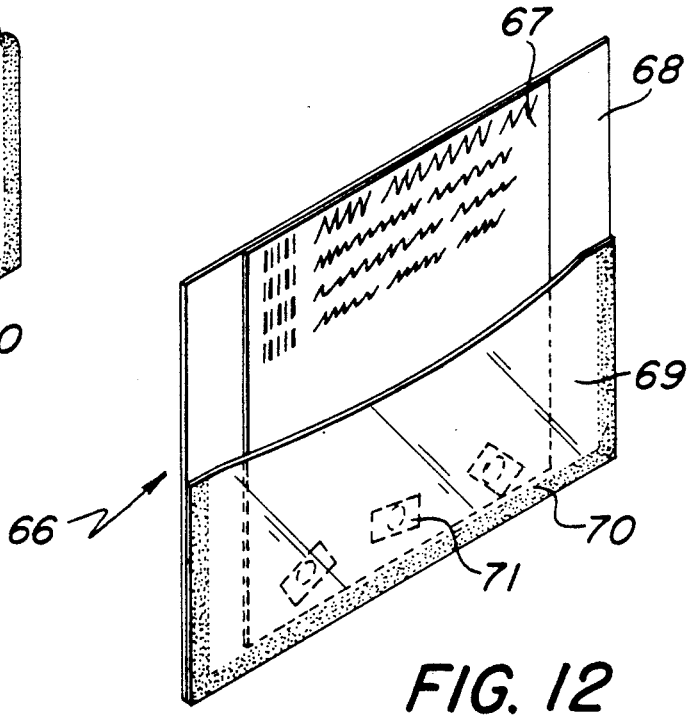
FIG. 12

CONTAINER APPARATUS

BACKGROUND OF THE DISCLOSURE

1. Field of the Invention

This invention pertains in general to dispensing apparatus for medication or the like and in particular to an apparatus for dispensing drugs that will reduce medication errors and alleviate the workload of medical personnel.

2. Description of the Prior Art

It is the present practice in modern day hospitals that medications for various patients are provided by the pharmacy department for later dispensing by nurses on the floor.

To assist in this practice an individual cart is provided for each nursing station on a floor which has been loaded with pharmaceuticals for a particular day. As understood in the art, as one cart loaded with medications is being used by staff to dispense medications to patients during drug rounds, other carts are being filled by the pharmacy with appropriate patient medications for dispensation during the following day.

The existing system assigns a separate drawer for each patient, into which are placed all of the drugs for that patient for one day, or for one period of time. The dispensing nurse must consult the medication administration record (MAR), figure which drugs she needs for the current round time, then sort through all the drugs in the drawer to pick out those wanted for this particular time. This procedure is error-prone in that she may pick the wrong drug. The new system removes the possibility of error by providing only those drugs that are to be given at that time in a container which identifies the patient and identifies each drug that the patient is to be given at this time.

It is also of interest to observe that envelope-type containers for dispensing medications are presently in use by institutions such as the Johns Hopkins University Hospital facility. The Johns Hopkins container apparatus, whose width dimension is greater than its heighth, utilizes a transparent open-ended pocket located upon the backside of the container; in this configuration the open end is located on the right.

Information relating to the patient and drugs is located on the front of the container and is read with the width dimension horizontal. However, when the containers are transported to the various patients they are carried in a tray with the height dimension horizontal and the pocket opening facing upwardly. In this manner the unit dosages of medication cannot fall out. This container configuration is less desirable since the necessary upward orientation of the pocket makes the patient and drug information difficult to read because it is ninety degrees from the horizontal.

The above prior art apparatus for medication dispensation is not considered desirable since the transparent pocket located on the back makes it more difficult for the nurse to check the drug name on the unit dose against the drug name on the printing located upon the front of the container apparatus.

The prior art is also deficient because when the dispensing envelopes are transported from place-to-place, they are held in six inch wide trays. As a result, the envelopes are positioned in the tray with the open end of the pocket in an upward position and the printing on the front of the backing sheet ninety degrees from the horizontal. This arrangement is not desirable for dispensing the needed medications.

SUMMARY OF THE INVENTION

A hospital dispensing apparatus and system for transferring drugs from its pharmacy department to the patient is disclosed. The apparatus is essentially comprised of a drug container that simplifies picking the correct drug in the pharmacy and simplifies the burden upon the nurse charged with distributing the correct medications at the correct time to the correct patients.

The drug container consists essentially of a transparent or semi-transparent pocket formed upon a backing sheet which is suitable for receiving graphical information or output printing from a computer output printer. The print-out may describe all pertinent information required for identification of the medications, for identification of the patient and for the dispensing of the correct medications to the correct patient at the correct time.

The drug container herein is of light weight, thin profile together with the transparent pocket part allows the hospital's pharmacy to load individual containers for a patient with required unit dosages for a particular time period. As a consequence, all of the medications required for a patient during the day may be easily dispensed by a nurse without being burdened by a need to sort through the drawers of the prior art cart system.

The transparent portion of the drug container of the invention not only provides a pocket for holding the required drugs but in addition when the unit dosage of a medication is encapsulated with foil upon which its name, strength, lot number and expiration date are imprinted, it can be easily recognized and selected by the dispensing nurse. This feature greatly enhances the utility of the drug container.

The drug container described herein may be modified to provide a double fold directly above the transparent fold. This feature allows the drugs to be trapped in the pocket so that they cannot fall out.

It is therefore an object of the invention to provide a new and improved article container.

It is still another object of the invention to provide a new and improved article container which is particularly useful for the dispensing of medication in a hospital or nursing home setting.

BRIEF DESCRIPTION OF THE DRAWINGS

FIG. 1 is an isometric view of the drug container embodiment of the invention.

FIG. 2 is a view of another embodiment of the drug container of the invention.

FIG. 3 is a view of an embodiment of the invention where the pocket of the container is sealed at a discrete point.

FIG. 4 is a view which illustrates an embodiment where a perforation is provided around the pocket sealing point of FIG. 3.

FIG. 5 is a view which represents the embodiment of FIG. 4 where information including bar-code information is provided on the backing sheet of the container.

FIG. 6 is a view depicting information that is provided upon the backing sheet as well as the outside of the pocket.

FIG. 7 is a view showing the embodiment of FIG. 6 where the perforations around the pocket sealing is broken.

FIG. 8 is a view depicting an embodiment which employs two creases in addition to the perforated sealing point.

FIG. 9 is a sectional view taken along line 9—9 of FIG. 8.

FIG. 10 is a view of another embodiment of the invention which shows location of fold lines for use in a double fold arrangement.

FIG. 11 is a view illustrating the double fold arrangement of FIG. 10.

FIG. 12 is a view showing the container of the invention which includes a disposable print-out sheet.

DESCRIPTION OF THE PREFERRED EMBODIMENTS

Figure 13:
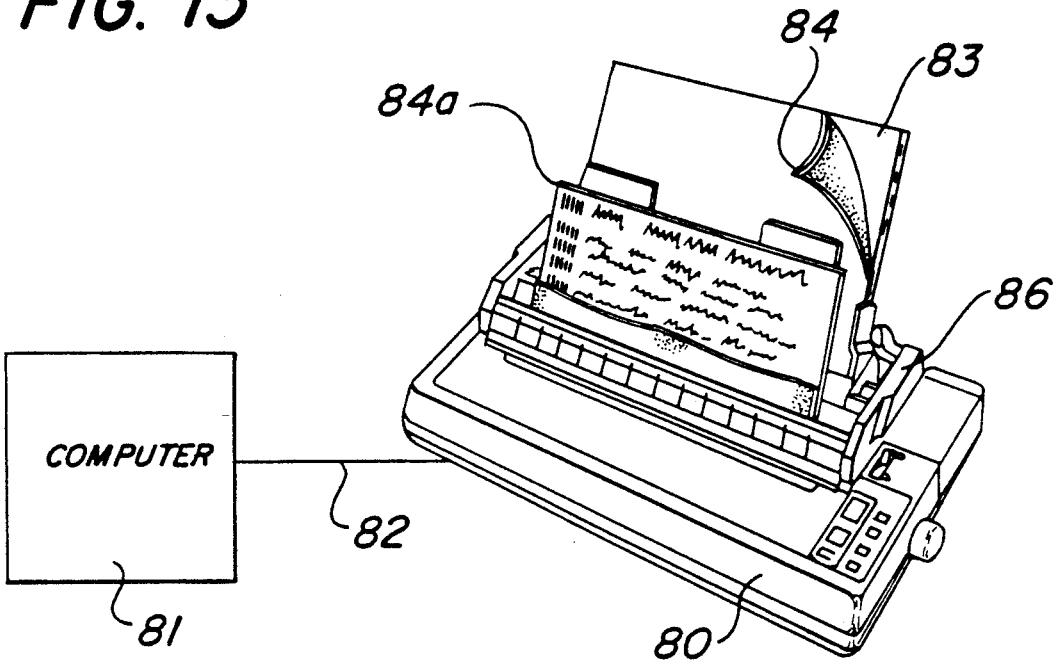
FIG. 13 depicts the drug container apparatus located within a computer printer.

Referring now to the drawings and, in particular, to FIG. 1, there is shown a container apparatus 10 for holding small items such as dry and liquid medications, injectables and disposable syringes. The apparatus 10 essentially consists of a transparent or semi-transparent plastic sheet 14 of 0.0015 inch thick polyethylene film or the like positioned upon a 0.005 inch thick opaque backing sheet 12 which as a background suitable for receiving a variety of computer print-out. The plastic sheet 14 is attached to the backing sheet 12 by a suitable bonding material 16 to form a pocket suitable for the above-stated small items. The pocket is approximately eight and one-half inches wide and is formed along the lower 30–90% of the height of the backing sheet 12.

The apparatus 10 finds particular use in the dispensation of unit doses of medications on a particular floor of a hospital. The medications are placed in the pocket 14 by the hospital pharmacy department which selects the required unit dosages from the hospital formulary in accordance with physician's instruction as recorded by computer print-out upon the near surface of the backing sheet 12. As is readily understood, the unit dosages are for the most part encapsulated in a foil-like material which is imprinted with the medication name, dosage, expiration date, and optionally, machine readable bar coding of identification data.

The drug container 10 of FIG. 1 may be modified as in FIG. 2 with a container 11 having multiple pockets 15, 17. Container 11 is designed with a single transparent or semi-transparent plastic sheet 9 which is located and positioned upon the lower 60–90% of the backing sheet 7. The plastic sheet 9 is permanently located upon the backing sheet 7 by an adhesive bonding line 19 which is located along the outside edges of the container 11. A bonding line 19*a* is also provided along the middle of the front transparent sheet 9 and a slit 8 is formed below the bonding line. As a result the container 11 of FIG. 2 is furnished with two transparent pockets such that a space above the top line of pocket 15 is exposed upon the backing sheet 7 for receiving printed matter.

FIG. 3 is an embodiment of the invention that is related to the embodiment of FIG. 1 but which is found particularly suitable for use with a computer printer see FIG. 13. The container or carrier 13 is provided with an attaching device 18 such as a glue spot which maintains a top edge of the sheet 14 against the backing sheet 12. In all other respects the pocket is identical to the container 10 of FIG. 1 and the bonding line 16 is applied to the edges of the sheet 14 for attachment to the backing sheet 12.

The container 13 is suitable for use with a computer as it prints patient information upon the backing sheet 12 above the sheet 14 because the top edge 14*a* will not get caught in the printer feeding mechanism and cause misfeeds. As is understood, after suitable printing relating to a patient has been placed upon the backing sheet 12, the glue spot 18, which may be pressure sensitive glue, is easily separated so the top edge 14*a* may be separated from the backing sheet 12 for providing the transparent or semi-transparent pocket for use as a drug container.

FIG. 4 represents a variation of the container 13 where a permanent glue or bonding spot 24 is partially surrounded by perforations 25 which were previously die-cut on the front of sheet 14 near its top edge. As mentioned with respect to container 13, the glue spot 24 helps to keep the top edge of sheet 14 against the backing sheet 12 during feeding and printing in the computer printer. After printing is done the perforations 25 are broken loose to separate the backing sheet 12 from the sheet 14 to form a pocket receptacle for receiving drugs or like articles. The bonding line 16, as in the previously discussed containers, is utilized to attach three edges of the sheet 14 to backing sheet 12.

The flexible container apparatus of FIGS. 1–4 are intended for use in pharmacological departments of a hospital or clinic where great care must be exercised in the dispensation of medications to a patient; in addition, the medication must be dispensed by medical personnel with certain economies in order to allay cost problems presently associated with most hospitals. The container apparatus of this invention may also be advantageously used in an automated or semi-automated system.

FIG. 5 shows container 20 after printed matter has been added by a computer output printer. Various types of printing are shown and include text 27, enlarged text 35, bar coding 28 and graphical FIGS. 32. Printed matter may include anything printable on a computer output printer including color; in addition, printed matter may also include pre-printed matter that is placed upon the container during manufacture of the article.

FIG. 6 is a representation of an embodiment identical to FIG. 5 wherein output printing from a computer printer may be applied upon the transparent or semi-transparent sheet 14 as well as the backing sheet 12 of container 40. The black printing upon the sheet 14 is visible and therefore easily readable by medical personnel in view of the light colored background of the backing sheet 12. The ability to apply printing to the transparent or semi-transparent sheet 14 as well as the backing sheet 12 enhances the amount of data that may be applied to the container 40 which increases its versatility. This increased capacity for printing data may be required when many different medications are being dispensed to a patient by a physician.

FIG. 7 depicts the embodiment of FIG. 6 where the perforations 25 are broken in order to separate the pocket 14 from the backing sheet 12 and glue spot 24. This allows the upwardly facing pocket to be formed allowing various unit dosages 43 of medication to be stored; and in addition, the descriptive matter on the rectangular container of the unit dosages may be readily viewed by the nurse during the act of medication dispensation.

FIG. 8 represents another embodiment of a container 45 which employs creases 46, 47 which project against the inside of a pocket formed by the transparent sheet 14 with respect to the backing sheet 12. The glue spot 24 is provided in the manner previously described in order to maintain the pocket provided by sheet 14 tight against the backing sheet 12 during printing and feeding of the container 45 when passing through an output printer of a computer.

A sectional view taking through FIG. 8 along line 9—9 is depicted in FIG. 9 and this view illustrates how the creases 46, 47 project against the inside surface of the sheet 14.

Occasionally the top edge of the pocket formed by the sheet 14 will lie so close to the backing sheet 12 that it is somewhat difficult to enter the first drug or unit dosage into the pocket. The vertical creases 46, 47 formed upon the backing sheet 12 during manufacture of the container 45 hold the top edge 51 away from the backing sheet 12. The openings 53, 55 are therefore available to make easier the entrance of the drug into the pocket. The openings 53, 55 also permit an easy detachment of the sheet 14 from the glue spot 24.

In FIG. 10 another type container 56 of the invention is shown wherein two horizontal fold lines 57, 58 are provided. The lines 57, 58 are located above previously entered drugs 60 and below the top edge 61 of the pocket formed by the sheets 63, 64. The fold lines 57, 58 are furnished to provide a horizontal fold 65 as in FIG. 11 is able to prevent drugs or other contents from escaping from the pocket.

FIG. 12 is a container 66 which is designed in accordance with width and length dimensions to accept an individual printout sheet 67. The container 66 consists of the same basic construction as described in the previous embodiments. However, with the usage of a separate printout sheet having all of the data prerequisite for the support of the patient, there is no need to print out on the backing sheet 68 and transparent or semi-transparent sheet 69. This arrangement avoids any possible problems related to feeding the drug container 66 through an output printer.

If it is desired to reuse the drug container 66, the backing sheet 68 and the front transparent or semi-transparent sheet 69 may be made of thicker materials to allow for easy re-use; on the other hand, printout sheet 67 is easily disposable after use.

Printout sheet 67 is less in height than drug container 66 by an amount equal to the height of the bottom glue line 70 such that when the printout sheet 67 is placed in container 66, its top edge is at the same height as the top edge of sheet 68.

In use, the printout sheet 67 is placed in the drug container first, and then the drugs 71 are placed in front of it. If drug containers are being re-used, the administering nurse normally administers the drug 71 from container 66, disposes of the printout sheet 67 and saves the container 66 by storing it in a drug cart for return to the pharmacy.

Referring to FIG. 13 there is depicted the combination of a container apparatus 84 positioned upon the carriage 86 of an impact or non-impact computer printer 80. The container apparatus 84 is removed from a stack 83 in a serial manner to apply specified medication information relating to a patient upon sheet 84*a*. As understood, the printer 80 is connected via a connecting link 82 to the output terminal of a computer 81.

This invention has been described by reference to precise embodiments but it will be appreciated by those skilled in the art that this invention is subject to various modifications and to the extent that those modifications would be obvious to one of ordinary skill they are considered as being within the scope of the appended claims.

What is claimed is:

1. An apparatus comprising:

(a) a first transparent or alternately semi-transparent sheet;

(b) a second flexible and opaque backing sheet wherein said second sheet provides a greater height dimension than said first sheet;

(c) said first sheet being attached to said second sheet to form at least one upwardly facing pocket for viewing various contents identified by markings; and (d) said combined first and second sheet having a thickness for facile positioning within a carriage of a computer printer assembly for receiving printed matter upon at least said second sheet.

2. The apparatus in accordance with claim 1 wherein said pocket is adapted to receive medications having identifiable markings placed thereon.

3. The apparatus in accordance with claim 1 wherein said pocket is formed on the lower 30 to 90 percent of the height of said second sheet.

4. The apparatus in accordance with claim 1 wherein said pocket is open topped.

5. An article of manufacture in accordance with claim 1 wherein machine-readable printed matter is provided in conjunction with said printed matter.

6. The apparatus in accordance with claim 1 wherein said transparent sheet is semi-permanently attached along its top edge to said second sheet at one or more discrete locations intermediate its sides to allow for easy printing upon surfaces of said sheets.

7. The apparatus in accordance with claim 6 wherein said semi-permanent attachment is provided by an adhesive, and said attachment being readily detachable after said printed matter has been placed upon said sheets.

8. The apparatus in accordance with claim 7 wherein said semi-permanent attachment is surrounded by a plurality of perforations to allow for easy separation of the top edge from said second sheet after printing and before loading of medications into said pocket.

9. The apparatus in accordance with claim 8 wherein at least one vertical crease which crosses the top edge of said pocket is formed on one side of said perforation.

10. The apparatus in accordance with claim 9 wherein two vertical creases are formed in the rear of said second sheet.

11. The apparatus in accordance with claim 1 wherein two horizontal folds are located below the top edge of said first sheet for semi-permanently sealing the contents within said pocket.

12. An apparatus comprising:

(a) a first transparent or alternatively semi-transparent sheet which is capable of receiving printed matter;

(b) a second flexible opaque sheet backing sheet which is adapted to receive printed matter and when combined with said first sheet provides increased capacity for recording printed matter;

(c) said first sheet being attached to said second sheet to form at least one upwardly facing pocket for viewing various contents identified by markings relating to said printed matter upon said backing sheet;

(d) said pocket being located on the same side as the printed matter located upon said backing sheet; and (e) means attached to said upwardly facing pocket for keeping its topmost edge semi-permanently attached to said backing sheet during the application of said printed matter, (f) said printed matter being applied when said apparatus is positioned within a carriage of a computer printer assembly.

13. The article of manufacture in accordance with claim 12 wherein said first sheet is attached to said second sheet along its approximately lower 30–90 percent of its height.

14. The article of manufacture in accordance with claim 13 wherein an additional pocket is formed above said first mentioned pocket when said second sheet extends approximately 90 percent of its height, said additional pocket being formed by providing a bonding line in the approximate middle of said first sheet, further providing a slit in said first sheet under said bonding line.

15. The apparatus in accordance with claim 1 wherein said pocket is dimensioned to receive an additional sheet of printed matter which is viewable above and within said pocket, said pocket being formed on the lower 30 to 90 percent of the height of said second sheet and being adapted to view various medications or contents located in said pocket, said apparatus being non-disposable and re-usable after various pocket contents have been disposed.

* * * * *